US005884909A

United States Patent [19]

Umeda

[11] Patent Number: 5,884,909

[45] Date of Patent: Mar. 23, 1999

[54] PAPER FEEDER AND PRINTER

[75] Inventor: Takaichiro Umeda, Nagoya, Japan

[73] Assignee: Brother Kogyo Kabushiki Kaisha, Nagoya, Japan

[21] Appl. No.: 810,107

[22] Filed: Feb. 25, 1997

[30] Foreign Application Priority Data

Feb. 27, 1996 [JP] Japan ..... 8-039603

[51] Int. Cl.[6] ..... B65H 9/04

[52] U.S. Cl. ..... 271/242; 271/274

[58] Field of Search ..... 271/242, 273, 271/274, 10.11; 226/186, 187; 400/636.3

[56] References Cited

U.S. PATENT DOCUMENTS 4,197,024 4/1980 Huntoon ..... 400/636.3
4,997,179 3/1991 Mizutani et al. ..... 271/274
5,000,439 3/1991 Yoshizawa ..... 271/274
5,540,427 7/1996 Nitta et al. ..... 271/274
5,580,042 12/1996 Taniguro et al. ..... 271/274
5,620,174 4/1997 Taniguro et al. ..... 271/272

*Primary Examiner*—H. Grant Skaggs
*Attorney, Agent, or Firm*—Oliff & Berridge, PLC

[57] ABSTRACT

A paper feeder feeds a sheet of paper while interposing the sheet of paper between a pressure roller and a feed roller. The pressure roller is rotatably supported at its both ends by a pair of arms which are independently swingable about a fixed shaft. A plurality sets of such pressure rollers and arms are disposed along an axial direction of the feed roller. The respective arms independently make swinging movement, and the pressure rollers press the sheet of paper while making inclination respectively even when the feed roller and the sheet of paper have irregularities. Thus, the frictional force is generated over the entire sheet of paper, and the sheet of paper is fed without any inclination.

13 Claims, 5 Drawing Sheets

PAPER FEEDER AND PRINTER

BACKGROUND OF THE INVENTION

1. Field of the Invention

The present invention relates to a paper feeder for interposing, between two rollers, a sheet of paper supplied from an upstream section, and feeding the sheet of paper to a downstream section in accordance with rotation of the rollers. The present invention also relates to a printer provided with the paper feeder.

2. Description of the Related Art

A paper feeder, which may be carried on an ink-jet printer, has been hitherto known, for interposing, between two rollers, a sheet of paper supplied from an upstream section, and feeding the sheet of paper to a downstream section in accordance with rotation of the rollers.

Such a paper feeder has, for example, a structure as shown in FIG. 5. Namely, the paper feeder comprises, for example, a feed roller 51 to be driven and rotated by power transmitted from a motor or the like, a support shaft 53 spanned in parallel to the feed roller 51, an arm 55 swingably attached to the support shaft 53, a pressure roller 57 rotatably supported by a shaft disposed at a tip of the arm 55, and springs 59 arranged in a compressed state between the arm 55 and fixtures mounted on a main body (not shown). The arm 55 is energized by the springs 59 so that the pressure roller 57 is pressed against the feed roller 51. A sheet of paper is fed to a downstream section by using frictional force between the feed roller 51 and the sheet of paper in accordance with rotation of the feed roller 51 while interposing the sheet of paper between the feed roller 51 and the pressure roller 57.

In general, one feed roller 51 involves a plurality of the aforementioned pressure rollers 57 which are arranged along an axial direction. Such an arrangement is significant when a sheet of paper having irregularities is fed, or when the feed roller 51 has irregularities due to damage or wearing, because each of the pressure rollers 57 corresponding to each part of the sheet of paper in its widthwise direction individually moves and presses the sheet of paper in response to the irregularities on the feed roller 51 and the sheet of paper. Accordingly, sufficient frictional force is generated between the feed roller 51 and the sheet of paper. Thus, the sheet of paper is smoothly fed by the aid of the feed roller 51.

However, the pressure roller 57 is a component part made of metal produced in accordance with a precise cutting process, and the pressure roller 57 is relatively expensive as compared with other component parts made of resin. Therefore, a problem has hitherto arisen in that arrangement of an excessively large number of the pressure rollers 57 is disadvantageous in view of the cost.

Now, only from a simple viewpoint of cost reduction, the number of the pressure rollers 57 can be decreased by allowing the pressure roller 57 to have a length L longer than those hitherto used. However, if the length L of the pressure roller 57 is too long exceeding a certain extent, it is feared to exert, for example, the following bad influences. Namely, when the irregularities as described above are present, the load given by the pressure roller 57 is concentrated on portions corresponding to protrusions, while the load given by the pressure roller 57 scarcely applied to portions corresponding to depressions. As a result, the sheet of paper is not contacted with the feed roller 51 with sufficient pressure at the portions corresponding to the depressions, giving rise to partial shortage in frictional force between the feed roller 51 and the sheet of paper to cause, for example, inclination of the feeding direction for the sheet of paper.

SUMMARY OF THE INVENTION

The present invention has been made in order to solve the problems concerning the conventional technique described above, an object of which is to provide a paper feeder which can reliably feed a sheet of paper in a feeding direction while applying a uniform load in a widthwise direction of the sheet of paper even when a relatively long pressure roller is used. Another object of the present invention is to provide a printer provided with such a paper feeder.

According to a first aspect of the present invention, there is provided a paper feeder comprising:

- a roller system comprising a feed roller and at least one pressure roller pressing a sheet of paper against the feed roller to interpose the sheet of paper therebetween;
- a roller system-driving unit driving the roller system to feed the sheet of paper to a downstream section; and
- a support unit rotatably supporting the pressure roller on its rotation shaft at its both ends respectively and acting to independently vary each of positions for rotatably supporting the pressure roller with respect to a rotation shaft of the feed roller.

According to the paper feeder of the present invention, the pressure roller is rotatably supported on its rotation shaft at its both ends by the support unit which enables the respective positions of the rotation shaft of the pressure roller to independently vary relative to the position of the shaft of the feed roller. Therefore, when the sheet of paper having irregularities is fed, or when the feed roller has irregularities due to damage or wearing, the pressure roller presses the sheet of paper while the rotation shaft of the pressure roller inclines relative to the rotation shaft of the feed roller in response to the irregularities on the feed roller and the sheet of paper. Thus, the pressure roller can contact with the sheet of paper even though the sheet and/or the feeding roller has protrusions or depressions formed thereon. Namely, the pressure roller is not only capable of movement in parallel to the feed roller, but also capable of contact with the feed roller while maintaining a slight inclination with respect thereto. As a result, sufficient frictional force is generated between the feed roller and the sheet of paper, and the sheet of paper is smoothly fed by the aid of the feed roller regardless of existence of irregularities of the surface of the sheet or the feeding roller.

In the case of the paper feeder as described above, sufficient frictional force can be generated between the feed roller and the sheet of paper even when the pressure roller is longer than those hitherto used. Accordingly, the number of pressure rollers can be reduced to construct the paper feeder less expensively. Alternatively, in the case of the use of the pressure roller having an equivalent length as compared with those hitherto used, the contact state is more improved on the irregularities as compared with those hitherto used. Accordingly, the sheet of paper can be fed more reliably and smoothly over the entire width of the sheet of paper.

In the present invention, the support unit may be a pair of arms for enabling to independently vary each of the positions for rotatably supporting the pressure roller with respect to the rotation shaft of the feed roller. The structure for supporting the arms is not specifically limited provided that the arms can be operated independently from each other and the position of the rotation shaft of the pressure roller is displaced in accordance with the operation of the arms. However, for example, each of the pair of arms described above may be a swingable arm which is swingable about a common fixed shaft.

Alternatively, those preferably used in the present invention include, other than the swingable arms, a slidable member or a expandable-and-contractible member which can independently vary each of the positions for rotatably supporting the pressure roller in a direction apart from and close to the rotation shaft of the feed roller. Even in the case of the use of such arms, the respective positions for rotatably supporting the pressure roller can be varied independently, and the relative position of the rotation shaft of the pressure roller to the feed roller can be changed.

Further, the support unit may comprise a pair of arms, each of the arms has a side surface disposed on a side of a paper feeding passage, the side surface having a shape for leading a leading edge of the sheet of paper to arrive at a contact position between the feed roller and the pressure roller. Accordingly, the sheet of paper is guided along a guide surface of the paper guide. Thus, the leading edge of the sheet of paper fed from a paper supply cassette or the like can be accurately led to the contact position between the two rollers.

According to a second aspect of the present invention, there is provided a paper feeder comprising:

a roller system comprising a feed roller and at least one pressure roller interposing a sheet of paper between itself and the feed roller;

a roller system-driving unit driving the roller system to feed the sheet of paper to a downstream section; and an urging mechanism urging both ends of the pressure roller to be independently pressed against the feed roller respectively.

According to the paper feeder described above, the both ends of the pressure roller is urged by the urging mechanism in directions to be pressed against the feed roller independently from each other. Accordingly, the pressure roller may contact with the feed roller while having a slight inclination with respect to the feed roller. When the sheet of paper having irregularities is fed, or when the feed roller has irregularities due to damage or wearing, the pressure roller presses the sheet of roller while making inclination in response to the irregularities on the feed roller and the sheet of paper. Thus, the pressure roller contacts with the sheet of paper at positions corresponding to protrusions as well as at positions corresponding to depressions. As a result, sufficient frictional force is generated over the entire width of the sheet of paper between the feed roller and the sheet of paper, and the sheet of paper is smoothly fed without any inclination with respect to the feeding direction.

According to a third aspect of the present invention, there is provided a printer comprising:

a paper feeder including:

a roller system having a feed roller and pressure roller pressing a sheet of paper against the feed roller to interpose the sheet of paper therebetween;

a roller system-driving unit driving the roller system to feed the sheet of paper to a downstream section; and a support unit rotatably supporting the pressure roller on its rotation shaft at its both ends respectively and acting to independently vary each of positions for rotatably supporting the pressure roller with respect to a rotation shaft of the feed roller; and a printing unit disposed adjacent to a paper feeding passage.

According to a fourth aspect of the present invention, there is provided a printer comprising:

a paper feeder including:

a roller system having a feed roller and at least one pressure roller interposing a sheet of paper between itself and the feed roller;

a roller system-driving unit driving the roller system to feed the sheet of paper to a downstream section; and an urging mechanism urging both ends of the pressure roller to be independently pressed against the feed roller respectively; and a printing unit disposed adjacent to a paper feeding passage.

The printer according to the third or fourth aspect of the present invention further may comprise a controller controlling the roller system-driving unit so that the feed roller is allowed to start rotation in a positive direction after the sheet of paper fed from an upstream section arrives at a contact position between the feed roller and the pressure roller. This arrangement allows the sheet of paper to abut against the contact position between the two rollers so that the leading edge of the sheet of paper is properly positioned. After that, the paper feeder is operated as described above, making it possible to accurately and smoothly feed the sheet of paper to a position in front of a printing head. The printer of the present invention may be controlled as follows. Namely, the feed roller is rotated in the positive direction after the sheet of paper abuts against the contact position and the sheet of paper starts to undergo bending.

In one preferred embodiment of the printer, a plurality of the pressure rollers described above are arranged along an axial direction of the feed roller, and the support unit is provided corresponding to the respective pressure rollers. In such an arrangement, the respective pressure rollers are individually inclined in response to irregularities on the feed roller and/or the sheet of paper, and thus the pressure rollers press the sheet of paper at each part of the sheet of paper in its widthwise direction. Accordingly, sufficient frictional force is generated between the feed roller and the sheet of paper, and the sheet of paper is smoothly fed by the aid of the feed roller regardless of existence of irregularities on the sheet and the feed roller.

A variety of more specified embodiments of the printer of the present invention may be conceived by a person skilled in the art. For example, the printing unit may have an ink-jet head for performing printing by jetting ink droplets. In such an embodiment, it is possible to construct an ink-jet printer which is excellent in function to feed sheets of paper.

The paper feeder of the present invention may be carried on a printer provided with a printing head of a system other than the ink-jet system. Further, the use of the paper feeder of the present invention is not limited to the printer, and the paper feeder of the present invention may be carried, for example, on facsimile machines and copy machines.

DETAILED DESCRIPTION OF PREFERRED EMBODIMENTS

An embodiment of the present invention will be explained below with reference to the drawings. A specified apparatus and its components, which will be explained below, are merely illustrative of the embodiment of the present invention. The present invention is not limited to the specified embodiment illustratively described below.

Figure 1:
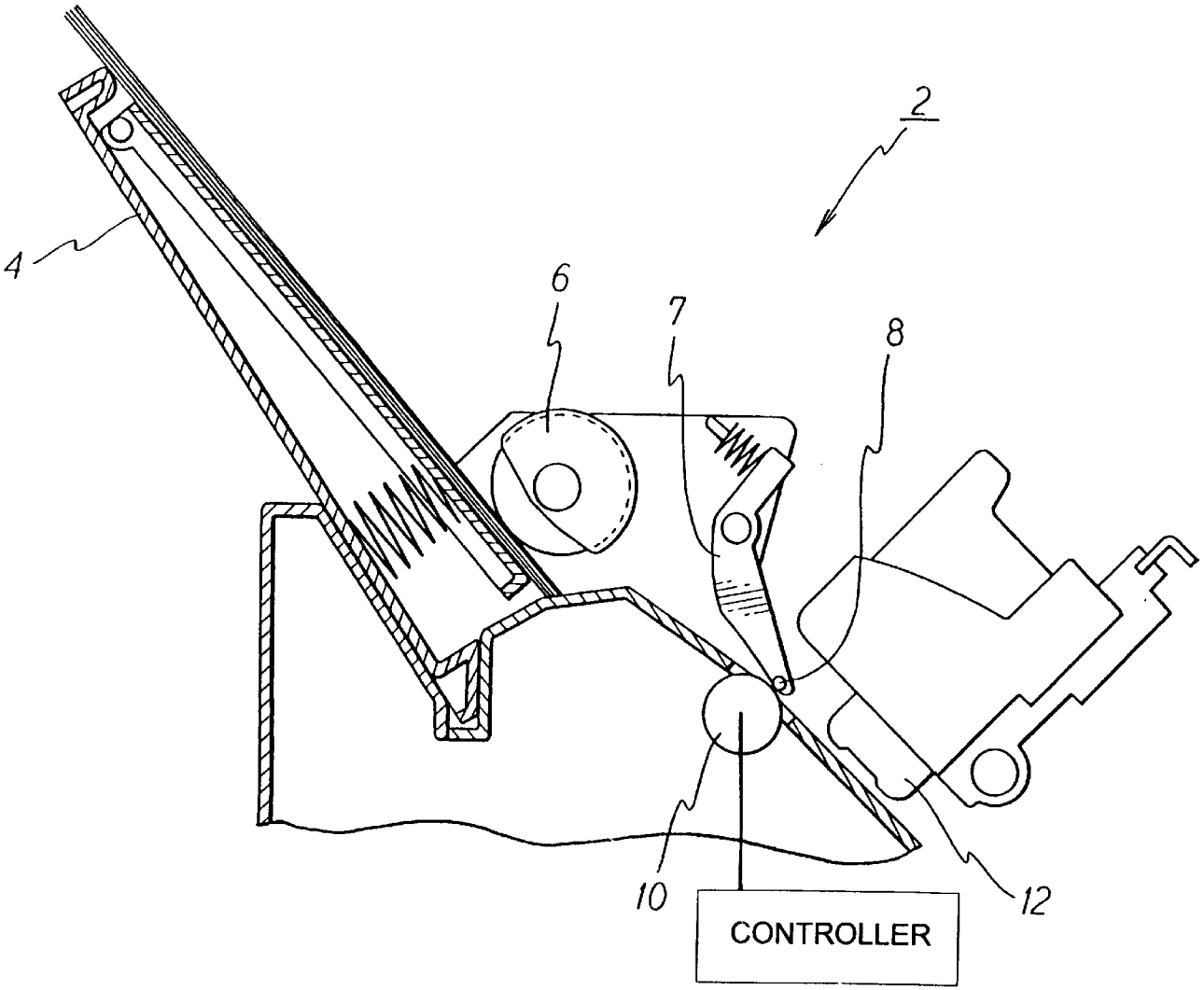
FIG. 1 shows a vertical cross-sectional view illustrating a schematic arrangement of main parts of an ink-jet printer which carries a paper feeder according to the present invention.

As shown in FIG. 1, an ink-jet printer 2 comprises a paper supply cassette 4 for accommodating a large number of stacked sheets of paper, a paper supply roller 6 for feeding the sheet of paper one by one from the paper supply cassette 4 to a downstream section when it is driven and rotated, arms 7 provided swingably over a feeding passage, pressure rollers 8 provided rotatably at tips of the arms 7 for pressing an upper surface of the sheet of paper passing through the feeding passage under the arms 7, and a feed roller 10 for feeding the sheet of paper to a position in front of a printing head 12 when it is driven and rotated while interposing the sheet of paper between itself and the pressure rollers 8.

Among the foregoing component parts of the ink-jet printer 2, the pressure rollers 8 are composed of a metal rod having a small friction coefficient. On the other hand, the feed roller 10 is composed of ordinary rubber having a large friction coefficient. The pressure rollers 8 and the feed roller 10 mainly constitute a roller system of the sheet feeder according to the invention.

Figure 2:
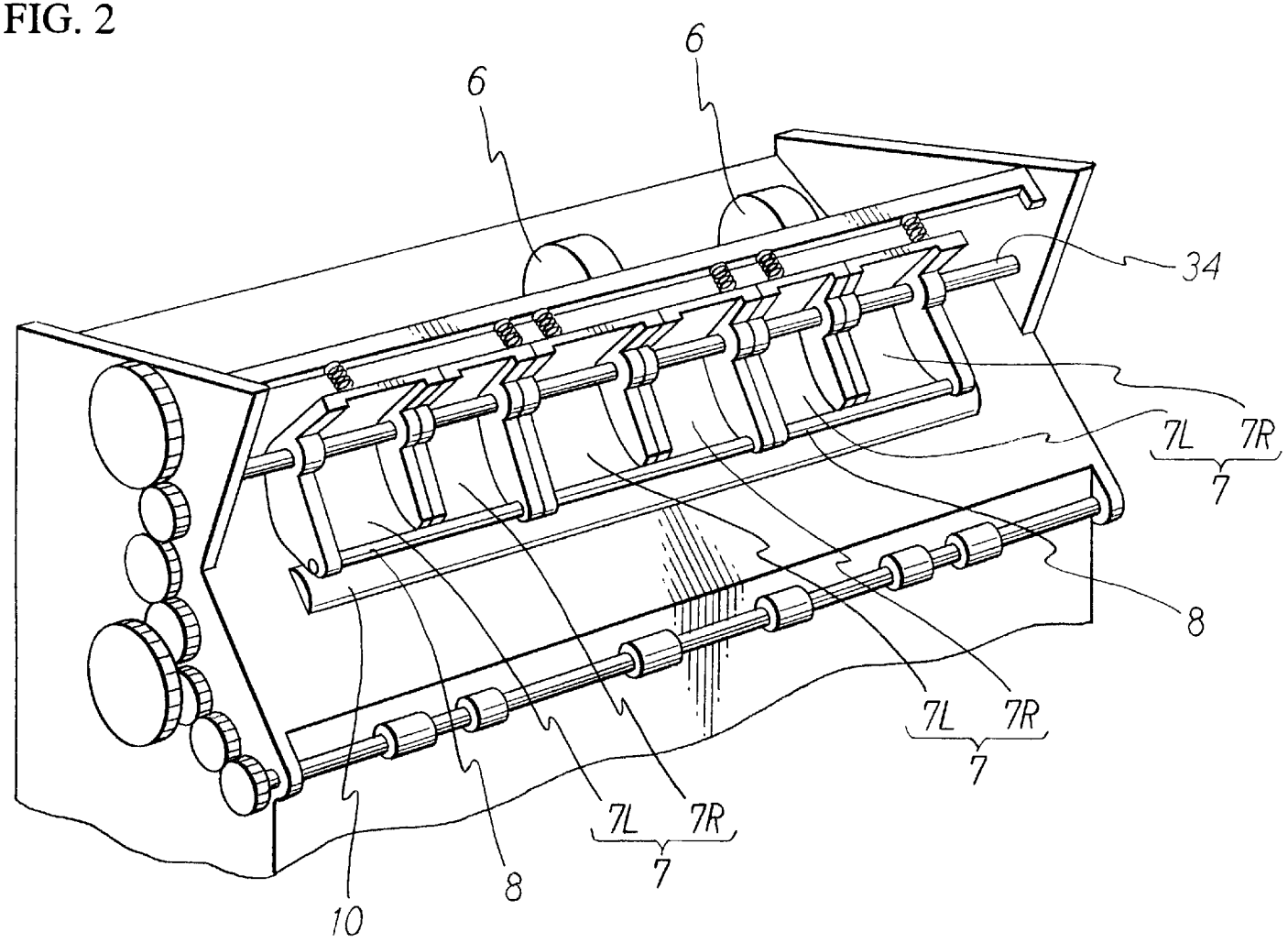
FIG. 2 shows a perspective view illustrating a schematic arrangement of main parts of the ink-jet printer which carries the paper feeder according to the present invention.

As shown in FIG. 2, one unit of the arm 7 comprises a pair of arms, i.e., a left arm 7L and a right arm 7R which are shaped to be bilaterally symmetrical to one another. The respective arms 7L, 7R are swingably supported by a common arm shaft 34 fixed to a main printer body. In this embodiment, three pairs of the left arms 7L and the right arms 7R are arranged and aligned on the arm shaft 34. Each of the pressure rollers 8 is supported by each of the pairs of the arms 7, and the three pressure rollers 8 are disposed along an axial direction of the feed roller 10.

Figure 3:
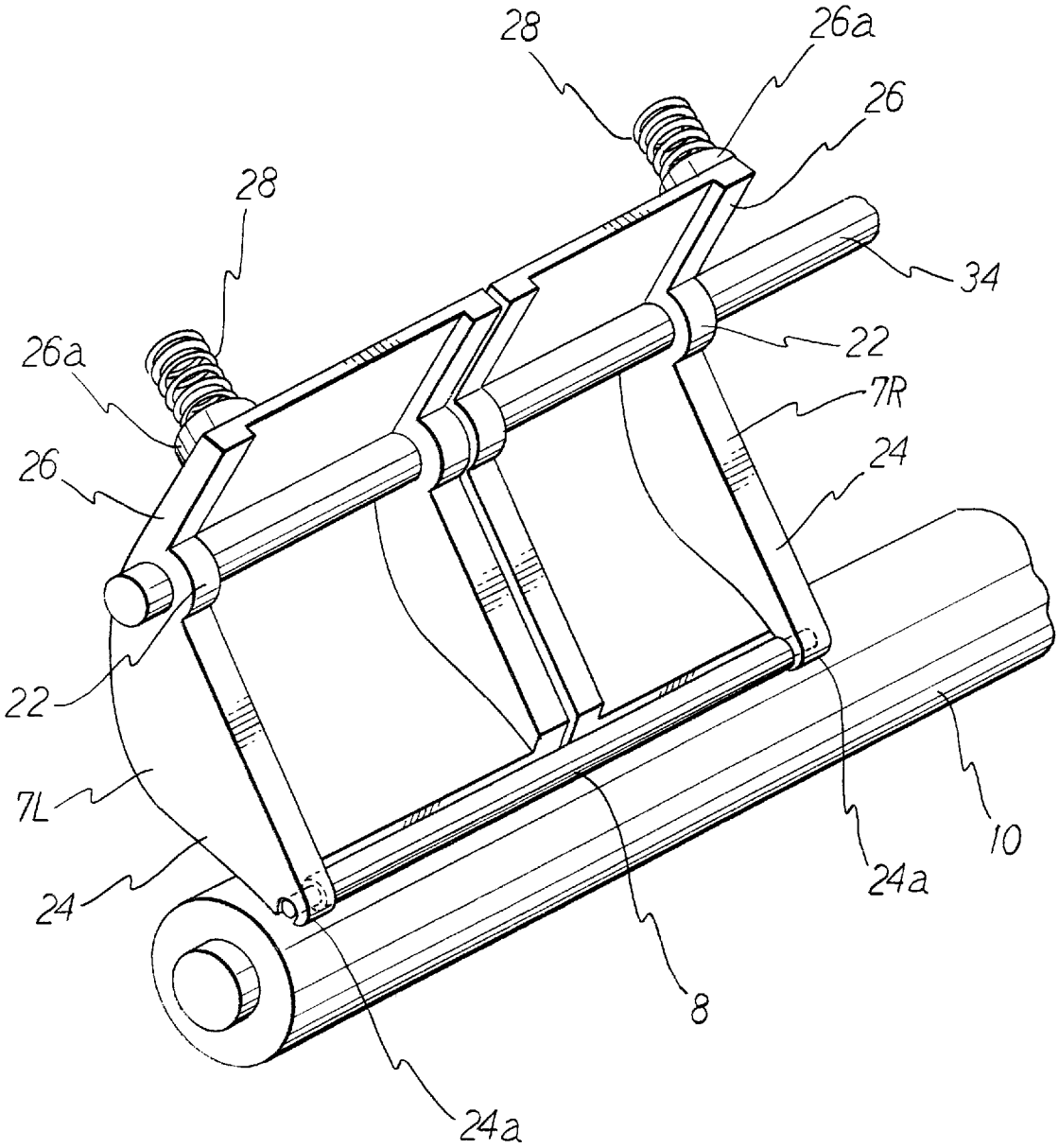
FIG. 3 shows a perspective view illustrating those disposed in the vicinity of a pressure roller and a feed roller.

As shown in FIG. 3, each of the left arm 7L and the right arm 7R comprises a bearing 22 to serve as a supporting point for swinging movement, a first paper guide 24 extending from the bearing 22, and a spring receiver plate 26 extending from the bearing 22 on a side opposite to the first paper guide 24. A bearing 24*a* is formed at a tip of the first paper guide 24. Both ends of one pressure roller 8 are rotatably supported by the both of the left arm 7L and the right arm 7R. The left arm 7L and the right arm 7R are swingable about the arm shaft 34 independently from each other. When oily one of the left arm 7L and the right arm 7R swings, or both the arms 7L, 7R swings with different swing angle, the shaft 60 of the pressure roller 8 is displaced to be slightly inclined with respect to the shaft 70 of the feed roller 10 in response to the swinging.

Figure 4:
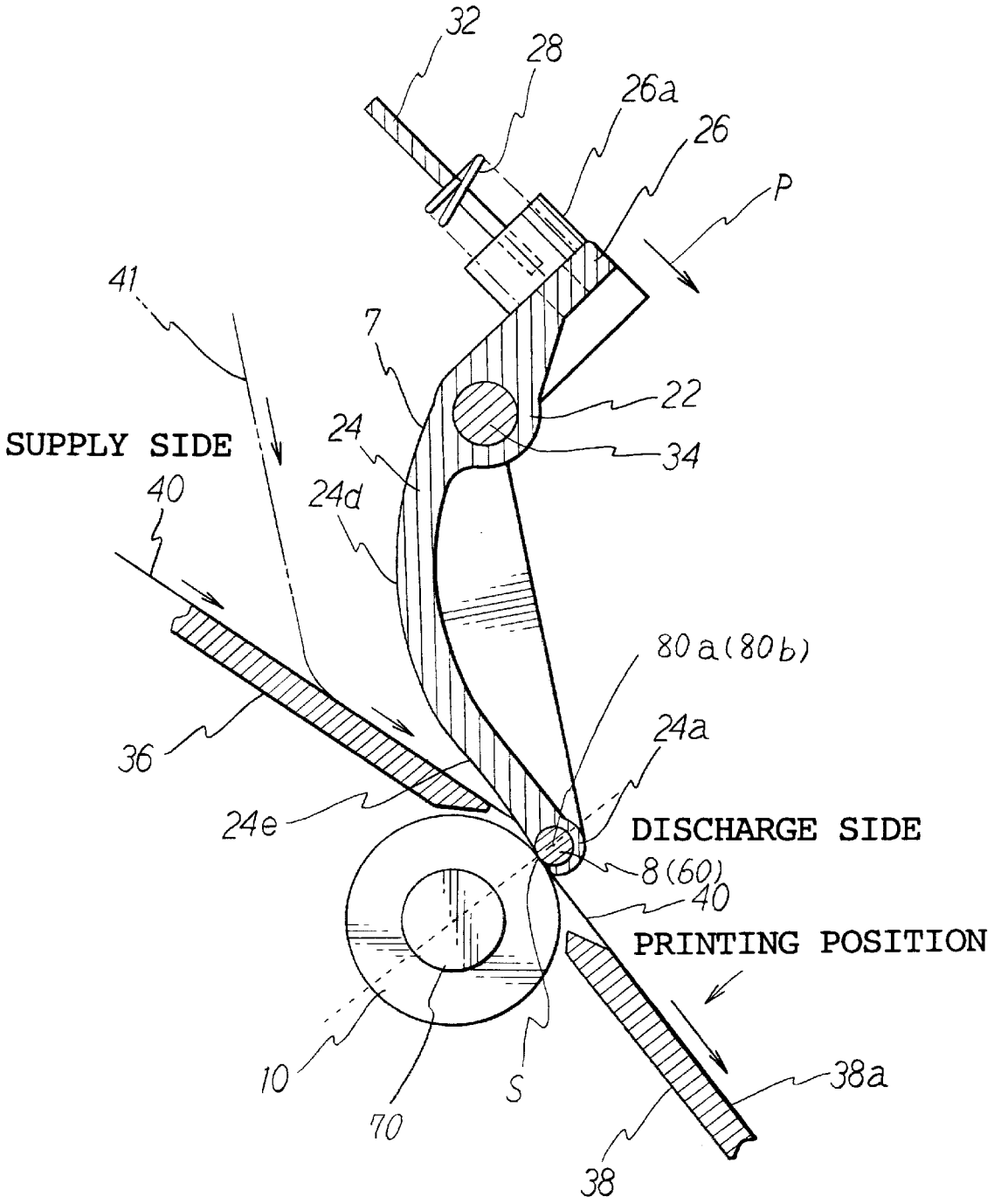
FIG. 4 shows a cross-sectional view illustrating those disposed in the vicinity of the pressure roller and the feed roller.
Figure 5:
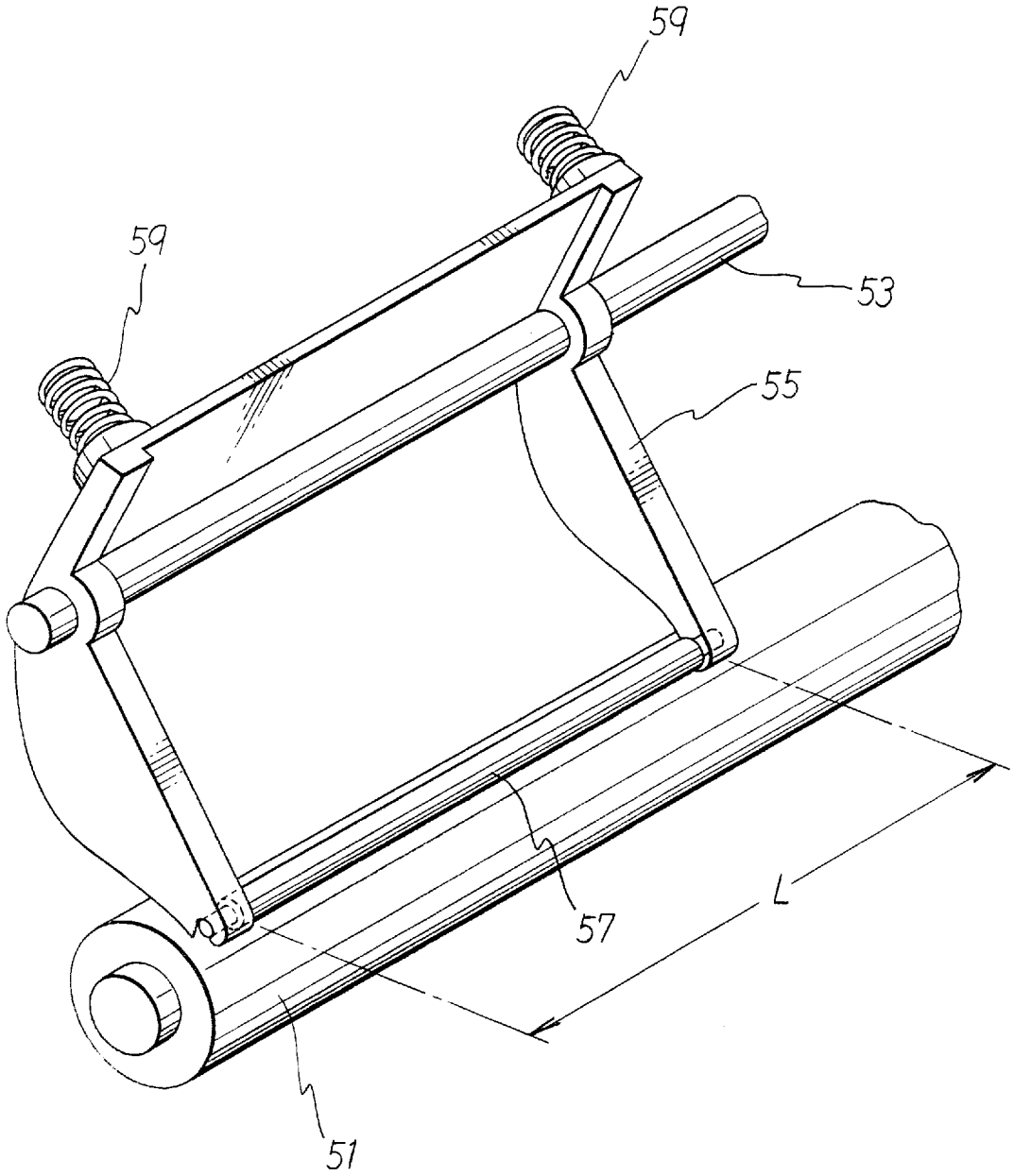
FIG. 5 PRIOR ART
FIG. 5 shows a perspective view illustrating those disposed in the vicinity of a pressure roller and a feed roller included in a conventional paper feeder.

Springs 28 are arranged respectively on a plurality of cylindrical spring receivers 26*a* provided on the spring receiver plates 26 of the respective arms 7. As shown in FIG. 4, the spring 28 is held in a compressed state between a spring support plate 32 and the spring receiver plate 26. The spring receiver plate 26 is urged by the spring 28 in a direction of an arrow P illustrated in FIG. 4. The pressure roller 8 is disposed on a side opposite to the spring receiver plate 26 with respect to the shaft 34 for swinging movement of the arm 7. Therefore, the pressure roller 8 is pressed against the circumferential surface of the feed roller 10 by the aid of the moment generated by the repulsive force of the spring 28. A plurality of ribs 24*c* for reinforcing the first paper guide 24 are provided on a concave side surface 24*b* of the first paper guide 24.

It is preferred that the arms 7 rotatably support the pressure roller 8 such that the positions 80*a*, 80*b* on the arm 7 for rotatably supporting the pressure roller 8 are movable substantially on and along a straight line which is formed by connecting the rotational axis of the feed roller 10 and the rotational axis of the pressure roller 8 when the pressure roller 8 is pressed against the feed roller 10 without irregularities on the surfaces of the sheet paper 40 and the feed roller 10. The straight line is indicated in FIG. 4 as a dotted line. In this embodiment, the swingable arms 7 are manufactured to adjust in terms of the size and shape of the arms 7 and the relative position of the arm shaft 34 to the pressure roller 8 so that the rotation shaft 60 of the pressure roller 8 supported by the bearing 24*a* (the positions 80*a*, 80*b* on the arms 7 for rotatably supporting the pressure roller 8) moves on and along the dotted line when the swing arms 7 swing about the shaft 34 due to the existence of the irregularities on the feed roller 10 or sheet paper 40. Because of the preferred movement of the positions 80*a*,80*b* for rotatably supporting the pressure roller 8 on and along the dotted line, an appropriate feeding direction of the sheet 40 can be maintained even after the sheet passed through the nip between the pressure roller 8 and feed roller 10. If the positions 80*a*,80*b* for rotatably supporting the pressure roller 8 moves to be off the dotted line, that is, moves to shift before or behind the dotted line (upstream side or downstream side from the dotted line), the feeding direction of the sheet may change to affect a feeding accuracy. In particular, it is important for the ink-jet printer to keep a high feeding accuracy by the following reason. Namely, because ink-jet printer performs printing action by ejecting ink droplets onto a sheet surface, a dispersion of the size and position of the ink droplets can have a substantial influence on printing quality. In order to suppress the dispersion, it is desirable to maintain the appropriate feeding direction so as to keep constant the distance between the sheet and the ink-jet head.

As shown in FIG. 4, a second paper guide 36 is provided at a position upstream from a contact position S at which the pressure roller 8 contacts with the feed roller 10. The underlying second paper guide 36 supports the sheet of paper 40 fed from the paper supply roller 6 so that the sheet of paper 40 is led in a direction toward the contact position S. An opening for manual paper supply (not shown) is provided over the second paper guide 36. A manually fed sheet of paper 41 is also led in the direction toward the contact position S after it abuts against the second paper guide 36 to change its traveling direction.

A third paper guide 38 is provided at a printing position downstream from the contact position S. The underlying third paper guide 38 supports the sheet of paper 40 discharged from the contact position S, on a reference surface 38*a* as a surface of the third paper guide 38 so that the sheet of paper 40 is positioned upon printing.

As shown in FIG. 4, the first paper guide 24 has its surface disposed on the supply side to serve as a guide surface 24*d* formed to have a convex configuration as a whole. A concave guide surface 24*e*, which is oppositely curved to have a concave configuration, is formed at a tip of the guide surface 24*d*, i.e., at a portion just upstream from the contact position S. Namely, as viewed in a cross section taken along the feeding direction for the sheet of paper 40, the concave guide surface 24*e* is formed to have a substantially circular arc configuration, the arc having its center on the side of the sheet of paper 40. A narrow passage is formed between the feed roller 10 and the concave guide surface 24*e*. The concave guide surface 24*e*, which is formed at the tip of the guide surface 24 as described above, provides the following advantage. Namely, when the leading edge of the sheet of paper 40 having been guided to arrive at the tip of the guide surface 24*d* is further guided by the concave guide surface 24*e* to be interposed between the feed roller 10 and the pressure roller 8, then the sheet of paper 40 is allowed to have a shape configured in conformity with the concave guide surface 24*e*. As a result, the angle, at which the sheet of paper 40 comes into the contact position S, is stabilized to reduce the tendency for the sheet of paper 40 to be separated from the reference surface 38*a* when it emerges on the discharge side. Accordingly, the tendency to be separated from the reference surface 38*a* is suppressed as compared with a case in which the incoming angle of the sheet of paper 40 into the contact position S is an angle obtained by simply linear or convex guidance. Thus, the sheet of paper 40 has an enhanced tendency to closely contact with the reference surface 38*a*, making it possible to perform printing with a high degree of accuracy.

Printing operation is started as follows by using the ink-jet printer 2 constructed as described above. At first, the paper supply roller 6 is rotated, and only one sheet of paper is fed from the paper supply cassette 4. The sheet of paper fed from the paper supply roller 6 abuts against the first paper guide 24. The sheet of paper is guided in accordance with the suffice of the first paper guide 24, and the sheet of paper arrives at the contact position S between the pressure roller 8 and the feed roller 10. At this time, since the feed roller 10 is rotated in an opposite direction, or it is stopped, the sheet of paper abuts against the contact position S but is not pulled into the contact position S. The feed roller 10 is allowed to start rotation in a positive direction at a timing after the sheet of paper certainly abuts against the contact position S. Thus, the sheet of paper is further fed downstream. Because the leading edge of the sheet of paper is certainly pulled into the contact position S at the timing at which the feed roller 10 is allowed to start rotation in the positive direction, the feed amount of the sheet of paper can be counted in accordance with the amount of rotation of the feed roller 10. Thus, the printing start position as well as other operation parameters can be accurately controlled.

The direction of rotation of the feed roller 10 can be controlled, for example, by using a control mechanism or a controller as described below. The feed roller 10 and the paper supply roller 6 are driven by using an identical motor as a roller system driving unit. A clutch, which can switch the direction of rotation of the feed roller 10 in accordance with a number of rotational pulses of the paper supply roller 6, is allowed to intervene between the feed roller 10 and the motor. The feed roller 10 starts rotation in a direction (counterclockwise in FIG. 1) opposite to the direction of paper feed, simultaneously with the start of rotation of the paper supply roller 6 in the direction of paper feed. When the number of rotational pulses of the paper supply roller 6 arrives at a predetermined number of pulses, namely when the sheet of paper arrives at the contact position S between the pressure roller 8 and the feed roller, and the sheet of paper starts to undergo bending, then the clutch switches the direction of rotation of the feed roller 10. The switching timing for the clutch may be provided as follows. Namely, switching may be performed mechanically by using a gear having a predetermined shape coupled to the feed roller 10. Alternatively, a sensor may be used to detect the arrival or bending of the sheet of paper, and the motor for driving the feed roller 10 may be controlled on the basis of a detection signal. The feed roller 10 may be drive by a different motor from the motor for driving the paper supply roller 6. In this case, since the motor for driving the feed roller 10 enables the feed roller 10 to directly change the direction of the rotation, the clutch may be omitted.

After the feed roller 10 is allowed to start feeding of the sheet of paper, the pressure roller 8 presses the sheet of paper while being inclined in accordance with irregularities on the feed roller 10 and the sheet of paper, when the sheet of paper subjected to feeding has irregularities, or when the feed roller 10 has irregularities due to, for example, damage or wearing. Therefore, the pressure roller 8 contacts with the sheet of paper at positions corresponding to protrusions as well as at positions corresponding to depressions. As a result, sufficient frictional force is generated over the entire width of the sheet of paper between the feed roller 10 and the sheet of paper. Thus, the sheet of paper is smoothly fed without being inclined. In this embodiment, the ink-jet printer 2, which has the three pressure rollers 8 arranged therein, is excellent in feeding ability as compared with a conventional ink-jet printer having the same number of pressure rollers arranged therein. In another aspect, the paper feeder of the present invention can be provided less expensively as compared with a conventional paper feeder having an equivalent feeding ability, because it is sufficient for the former to provide a smaller number of pressure rollers as compared with the latter.

The embodiment of the present invention has been explained above. However, a variety of specified embodiments of the present invention other than the foregoing embodiment can be conceived.

The foregoing embodiment is an example illustrative of the paper feeder of the present invention carried on the ink-jet printer. However, for example, the paper feeder of the present invention may be carried on a printer which adopts another recording system, such as a laser printer, or the paper feeder of the present invention may be carried on an apparatus other than the printer, such as a facsimile machine and a copy machine.

The present invention may be practiced or embodied in other various forms without departing from the spirit or essential characteristics thereof. It will be understood that the scope of the present invention is indicated by the appended claims, and all variations and modifications concerning, for example, the number of the pressure rollers, the number of the pairs of arms, and the type of the apparatus on which the paper feeder is carried, which come within the equivalent range of the claims, are embraced in the scope of the present invention.

In the embodiment described above, although the feed roller is driven by the motor, the roller system in which the pressure roller is driven by a driving unit may be adopted.

What is claimed is:

1. A paper feeder comprising:

a roller system comprising a feed roller and at least one pressure roller interposing a sheet of paper between itself and the feed roller;

a roller system-driving unit driving the roller system to feed the sheet of paper to a downstream section; and an urging mechanism urging both ends of the pressure roller to be independently pressed against the feed roller respectively;

wherein the urging mechanism is a pair of swingable arms, each of the swingable arms having a first end which is supported by a resilient member, and a second end at which the pressure roller is rotatable supported at each of ends thereof on its rotation shaft, with a swinging shaft disposed between the first and second ends.

2. A printer comprising:

a paper feeder including:

a roller system having a feed roller and pressure roller pressing a sheet of paper against the feed roller to interpose the sheet of paper therebetween;

a roller system-driving unit driving the roller system to feed the sheet of paper to a downstream section;

a support unit rotatably supporting the pressure roller on its rotation shaft at its both ends respectively so that a position of each end of the rotation shaft can be independently varied relative to the feed roller;

a printing unit disposed adjacent to a paper feeding passage; and a controller controlling the roller system-driving unit so that the feed roller is allowed to start rotation in the positive direction after the sheet of paper fed from an upstream section arrives at a contact position between the feed roller and the pressure roller;

wherein, the roller system-driving unit rotates the feed roller in a positive direction to feed the sheet downstream.

3. The printer according to claim 2, wherein the printing unit has an ink-jet printing head for performing printing by jetting ink droplets.

4. The printer according to claim 2, wherein the support unit has a side surface disposed on a side of a paper feeding passage, the side surface having a shape for leading a leading edge of the sheet of paper to arrive at a contact position between the feed roller and the pressure roller, thereby allowing the support unit to function as a paper guide.

5. The printer according to claim 4, wherein the side surface has a convex shape projecting toward the paper feeding passage.

6. The printer according to claim 2, wherein the support unit comprises a pair of swingable arms swinging about a common fixed shaft to independently vary positions for rotatably supporting the pressure roller with respect to the rotation shaft of the feed roller.

7. The printer according to claim 6, wherein the swingable arms rotatably support the pressure roller such that each of the positions for rotatably supporting the pressure roller moves substantially on and along a straight line which is formed by connecting rotational axes of the feed roller and pressure roller.

8. The printer according to claim 2, wherein the support unit is composed of a slidable member which can independently vary each of the positions for rotatably supporting the pressure roller in a direction away from and close to a rotational axis of the feed roller.

9. The printer feeder according to claim 2, wherein a plurality of the pressure rollers are arranged in an axial direction of the feed roller, and the pair of arms are provided for each of the pressure rollers.

10. A printer comprising:

a paper feeder including:

a roller system having a feed roller and at least one pressure roller interposing a sheet of paper between itself and the feed roller;

a roller system-driving unit driving the roller system to feed the sheet of paper to a downstream section; and an urging mechanism urging both ends of the pressure roller to be independently pressed against the feed roller respectively;

a printing unit disposed adjacent to a paper feeding passage; and a controller controlling the roller system-driving unit so that the feed roller is allowed to start rotation in the positive direction after the sheet of paper fed from an upstream section arrives at a contact position between the feed roller and the pressure roller;

wherein, the roller system-driving unit rotates the feed roller in a positive direction to feed the sheet downstream.

11. The printer according to claim 10, wherein the urging mechanism is a pair of swingable arms, each of the swingable arms having a first end which is supported by a resilient member, and a second end at which the pressure roller is rotatably supported at each of ends thereof on its rotation shaft, with a swinging shaft disposed between the first and second ends.

12. The printer according to claim 11, wherein each of the swingable arms has a side surface disposed on a side of a paper feeding passage, the side surface having a shape for leading a leading edge of the sheet of paper to arrive at a contact position between the feed roller and the pressure roller, thereby allowing the swingable arm to function as a paper guide.

13. A printer comprising:

a paper feeder including:

a roller system having a feed roller and pressure roller pressing a sheet of paper against the feed roller to interpose the sheet of paper therebetween;

a roller system-driving unit driving the roller system to feed the sheet of paper to a downstream section;

a support unit rotatably supporting the pressure roller on its rotation shaft at its both ends respectively so that a position of each end of the rotation shaft can be independently varied relative to the feed roller; and a printing unit disposed adjacent to a paper feeding passage;

wherein the support unit comprises a pair of swingable arms swinging about a common fixed shaft to independently vary positions for rotatably supporting the pressure roller with respect to the rotation shaft of the feed roller: and wherein the swingable arms rotatably support the pressure roller such that each of the positions for rotatably supporting the pressure roller moves substantially on and along a straight line which is formed by connecting rotational axes of the feed roller and pressure roller.

* * * * *